US006758174B1

(12) United States Patent
Fuerhapter

(10) Patent No.: US 6,758,174 B1
(45) Date of Patent: Jul. 6, 2004

(54) METHOD OF OPERATING AN INTERNAL COMBUSTION ENGINE

(75) Inventor: Alois Fuerhapter, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/334,153

(22) Filed: Dec. 31, 2002

(30) Foreign Application Priority Data

Dec. 27, 2001 (AT) ..... 979/2001 U

(51) Int. Cl.[7] ..... F02B 75/02
(52) U.S. Cl. ..... 123/64
(58) Field of Search ..... 123/64, 26, 310

(56) References Cited

U.S. PATENT DOCUMENTS 6,561,139 B2 * 5/2003 Guy ..... 123/26
6,622,690 B2 * 9/2003 Ando et al. ..... 123/295

FOREIGN PATENT DOCUMENTS

| | | |
|---|---|---|
| AT | 3135 | 10/1999 |
| AT | 5140 | 3/2002 |
| DE | 3317128 | 11/1984 |
| DE | 3406732 | 8/1985 |
| JP | 10252511 | 9/1998 |
| JP | 200314318 | 11/2000 |

* cited by examiner

*Primary Examiner*—Andrew M. Dolinar
*Assistant Examiner*—Katrina B. Harris

(74) *Attorney, Agent, or Firm*—Dykema Gossett PLLC

(57) ABSTRACT

The invention relates to a method of operating an internal combustion engine with a six-stroke process involving the following sequence of events:

1st stroke (I): air intake into the combustion chamber,

2nd stroke (II): compression of the air and injection (3*a*) of a first fraction of gasoline fuel into the combustion chamber, 3rd stroke (III): first working stroke after first ignition (5) of the mixture, said ignition (5) being initiated by an ignition device, 4th stroke (IV): new compression of the contents of the combustion chamber, 5th stroke (V): second working stroke after second ignition (6) of the fuel-air mixture contained in the combustion chamber, 6th stroke (VI): expulsion of the exhaust gases from the combustion chamber, a second fraction of gasoline fuel being injected (3*b*) prior to the second ignition (6).

In order to achieve the lowest possible fuel consumption and low emissions in an internal combustion engine it is suggested that the second fraction of gasoline be injected (3*b*) during the third stroke (III), preferably during the second half of the third stroke (III), that an at least almost homogeneous fuel-air mixture be formed in the combustion chamber prior to the second ignition (6) and that the second ignition (6) occurs by compression ignition of said homogeneous fuel-air mixture.

7 Claims, 1 Drawing Sheet

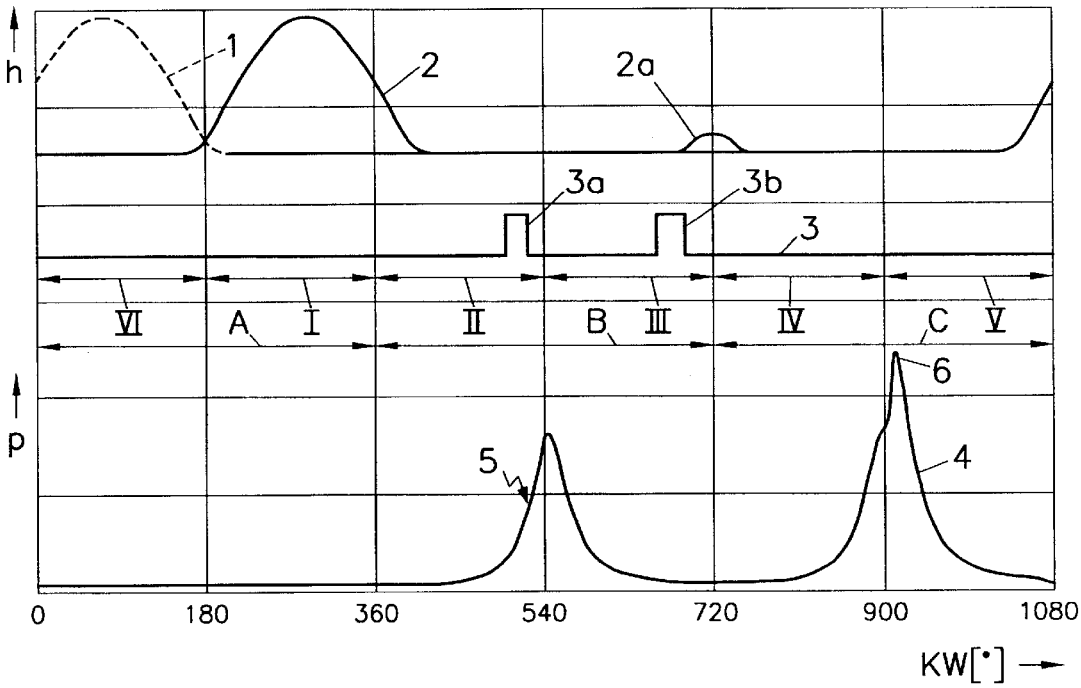
h
1
2
2a
3a
3b
3
VI
A
I
II
B
III
IV
C
V
6
p
5
4
0
180
360
540
720
900
1080
KW[°]

METHOD OF OPERATING AN INTERNAL COMBUSTION ENGINE

BACKGROUND OF THE INVENTION

The invention relates to a method of operating an internal combustion engine with a six-stroke process involving the following sequence of events:

$1^{st}$ stroke: air intake into the combustion chamber, $2^{nd}$ stroke: compression of the air and injection of a first fraction of gasoline fuel into the combustion chamber, $3^{rd}$ stroke: first working stroke after first ignition of the mixture, said first ignition being initiated by an ignition device, $4^{th}$ stroke: new compression of the contents of the combustion chamber, $5^{th}$ stroke: second working stroke after second ignition of the fuel-air mixture contained in the combustion chamber, $6^{th}$ stroke: expulsion of the exhaust gases from the combustion chamber, a second fraction of gasoline fuel being injected prior to the second ignition.

DESCRIPTION OF PRIOR ART

DE 34 06 732 A1 describes a working process for reciprocating internal combustion engines in which the fuel-air mixture is ignited either through an ignition device or by means of compression ignition. The working cycle process is carried out in six strokes and involves the following events:

$1^{st}$ stroke: intake, $2^{nd}$ stroke: compression and injection of a fraction of gasoline, $3^{rd}$ stroke: first working stroke, $4^{th}$ stroke: new compression of the exhaust gas still containing free oxygen and injection of a second fraction of gasoline, $5^{th}$ stroke: second working stroke, $6^{th}$ stroke: expulsion.

This method is described both for the diesel engine in which the fuel is self-ignited and for the Otto-cycle internal combustion engine in which the fuel is ignited through an ignition device.

DE 33 17 128 A1 describes an internal combustion engine operating on a six-stroke cycle. During the intake stroke, a fuel-air mixture is admitted into the cylinder and is compressed during a first compression stroke. After ignition of the compressed fuel-air mixture, an expansion stroke occurs. In a subsequent second compression stroke, the combustion products are compressed. At the end of the second compression stroke the in-cylinder contents are ignited by a spark plug. As a result of the expansion of the compressed combustion products, a second expansion stroke comes next, finally followed by an exhaust stroke during which the combustion gases are driven out of the cylinder.

In the known six-stroke internal combustion engines, diesel fuel is auto-ignited or gasoline is spark-ignited at the beginning of the first and of the second working stroke.

Internal combustion engines operating at least partially on the homogeneous charge spark ignition of gasoline require high charge temperatures and high amounts of residual gas to ensure ignition of the air-fuel-residual gas mixture.

AT 3.135 U discloses a method of operating an internal combustion engine with gasoline fuel relying for operation on both compression ignition and spark ignition. At part load, the internal combustion engine is operated in the compression ignition mode, a homogeneous fuel-air mixture being produced in the combustion chamber and combustion being initiated by compression ignition of said fuel mixture. The process known as HCCI combustion (Homogeneous Charge Compression Ignition) has particular advantages with respect to the production of emissions. AT 5.140 U describes a method by means of which auto-ignition of the homogeneous fuel-air mixture may be controlled by the residual gas content in the combustion chamber.

At low speed and load in particular, the exhaust temperature is no longer high enough to heat the charge to an extent sufficient to ensure auto-ignition, even if the amount of residual gas is extremely high. Moreover, at low speed, the longer cycle times negatively affect the charge temperatures as there is more time available for heat transfer.

SUMMARY OF THE INVENTION

It is the object of the invention to avoid these drawbacks and to develop a method of operating an internal combustion engine by means of which high efficiency on the one hand and low emissions on the other hand may be achieved.

This is achieved in accordance with the invention in that the second fraction of gasoline is injected during the third stroke, preferably during the second half of the third stroke, that an at least almost homogeneous fuel-air mixture is formed in the combustion chamber prior to the second ignition and that the second ignition occurs by compression ignition of said homogeneous fuel-air mixture.

There is thereby preferably provided that the fuel-air mixture formed during the second stroke is lean and stratified and is provided with high excess air with an air/fuel ratio of $\lambda>1.5$. The excess air makes certain that there will still be enough oxygen available for the second combustion. Specifically when very small quantities of fuel are injected, the lean stratified combustion results in very low $NO_x$ emissions. The temperature of the burned gas is relatively low but high enough to ensure secure compression ignition in the second combustion cycle. It is particularly advantageous when the combustion taking place during the fifth stroke subsequent to the second ignition is controlled by adjusting the quantity of the first fraction of gasoline fuel injected during the second stroke. By simply varying the quantity of the first injection or by changing the amounts apportioned to the first and second injection the combustion of the combustion gas and, as a result thereof, the starting condition for compression ignition may be changed or adjusted.

Moreover, stratified combustion has the advantage to be very efficient.

But homogeneous auto-ignition is also characterized by good efficiency. More specifically as far as $NO_x$ and soot emissions are concerned, compression ignition provides substantial advantages. The fact that possible soot or hydrocarbon emissions resulting from the first working cycle are used for further combustion and are burned as a result thereof positively affects emissions.

In a particularly preferred variant of the invention there is provided that adjustment in pressure is carried out in the region of transition between the third and the fourth stroke. The regulation of the level of pressure in the combustion chamber may be used for controlling auto-ignition. It is particularly advantageous when the pressure is adjusted by temporarily opening at least one lift valve, preferably one intake valve.

A first cycle consisting of the sixth and of the first stroke thereby serves for gas exchange, meaning for driving out exhaust gas, and for the intake of a fresh charge. The second cycle—second and third stroke—consists of compression, spark-ignited, lean stratified combustion (SCSI—Stratified Charge Spark Ignition) and expansion and forms the first working cycle. The lean exhaust gas resulting from this first working cycle is not driven out but remains inside the cylinder where it serves as a charge for the following third cycle (fourth and fifth stroke). Said third cycle is the second working cycle and is characterized by a homogeneous compression ignition (HCCI). The expulsion of exhaust gases of the first cycle follows.

The low loss in charge exchange and the combination of the two combustions SCSI and HCCI as well as the fact that this six-stroke working method provides for two working cycles for every charge exchange cycle guarantee high consumption potential and the lowest possible emissions.

BRIEF DESCRIPTION OF THE DRAWING

The invention is explained in further detail with respect to the FIG.

DETAILED DESCRIPTION OF THE PREFFERED EMBODIMENTS

The FIG. shows the valve lifts h of the exhaust valves and of the intake valves, the exhaust valve lift being indicated at 1 and the intake valve lift at 2.

Line 3 shows the injection events in the combustion chamber.

In the lower part of the diagram, the cylinder pressure p is plotted down the side thereof whereas the crank angle KW is plotted on the horizontal axis. This curve is indicated at 4.

The working method is comprised of six strokes I, II, III, IV, V, VI, two strokes pertaining to a respective one of a cycle A, B, C. The first cycle A serves for gas exchange and consists of stroke VI for exhaust expulsion and of stroke I for air intake. The second cycle B consists of stroke II during which the air is compressed inside the cylinder and a first fraction of gasoline fuel is injected and of stroke III, the first working stroke of the piston. At the end of stroke II, the first fraction of gasoline fuel is injected as indicated at 3*a*. Thereupon, at the end of stroke II, the lean and stratified mixture is ignited by an ignition device as indicated at 5. Lean stratified combustion occurs. The lean exhaust of the first working cycle B is not driven out but remains inside the cylinder where it serves as a charge for the subsequent third cycle C, the second working cycle. The second working cycle is comprised of stroke IV during which the in-cylinder content is compressed anew and of stroke V, the second working stroke of the piston.

In the second half of stroke III, a second fraction of gasoline fuel is injected into the combustion chamber. This early injection permits to achieve homogenisation of the mixture no later than at the moment of the second ignition indicated at 6. The second ignition 6 is a compression ignition. Next, the exhaust is driven out during stroke VI.

Between the two working cycles B and C, at least one intake valve may be opened for a short time interval in order to regulate the level of pressure in the cylinder. This brief opening of the intake valve is indicated at 2*a*. The adjustment in pressure achieved by opening the intake valve for a short time interval in the region of bottom dead center between cycle III and cycle IV may be used for controlling auto-ignition.

The lean stratified combustion in working cycle B works with high excess air and produces very low $NO_x$ emissions, more specifically when a very small quantity of fuel is injected. The temperature of the burned gas is very low as well, but still high enough to ensure secure auto-ignition in the subsequent working cycle C. The composition of the combustion gas and, as a result thereof, the starting condition for compression ignition 6 may be changed or adjusted by simply varying the quantity of injected fuel. Both stratified combustion and homogeneous auto-ignition are characterized by high efficiency.

Compression ignition 6 provides distinct advantages more specifically as far as $NO_x$ and soot emissions are concerned. The fact that soot or hydrocarbon emissions possibly resulting from the first working cycle B are used for further combustion and are burned as a result thereof also positively affects the emissions.

The low loss in charge exchange and the combination of the two combustions as well as the fact that in the six-stroke process described there are two working cycles B, C for one charge exchange cycle a guarantee high consumption potential and the lowest possible emissions.

What is claimed is:

1. A method of operating an internal combustion engine with a six-stroke process involving the following sequence of events:

$1^{st}$ stroke: air intake into a combustion chamber, $2^{nd}$ stroke: compression of the air and injection of a first fraction of gasoline fuel into the combustion chamber, $3^{rd}$ stroke: first working stroke after first ignition of a fuel-air mixture, said ignition being initiated by an ignition device, $4^{th}$ stroke: new compression of the contents of the combustion chamber, $5^{th}$ stroke: second working stroke after second ignition of the fuel-air mixture contained in the combustion chamber, $6^{th}$ stroke: expulsion of exhaust gases from the combustion chamber, a second fraction of gasoline fuel being injected prior to the second ignition, wherein the second fraction of gasoline fuel is injected during the third stroke, wherein an at least almost homogeneous fuel-air mixture is formed in the combustion chamber prior to the second ignition and wherein the second ignition occurs by compression ignition of said homogeneous fuel-air mixture, and wherein a pressure in the combustion chamber is adjusted in a region of transition between the third and the fourth stroke.

2. The method according to claim 1, wherein the second fraction of gasoline is injected during a second half of the third stroke.

3. The method according to claim 1, wherein a stratified, lean fuel-air mixture having an air/fuel ratio of $\lambda>1.5$ is formed during the second stroke.

4. The method according to claim 1, wherein the pressure is adjusted by briefly opening a lift valve.

5. The method according to claim 4, wherein said lift valve is an intake valve.

6. The method according to claim 4, wherein a plurality of lift valves are lifted.

7. The method according to claim 1, wherein combustion taking place during the fifth stroke subsequent to the second ignition is controlled by adjusting a quantity of the first fraction of gasoline fuel injected during the second stroke.

* * * * *